United States Patent [19]

Kremer et al.

[11] 3,961,109

[45] June 1, 1976

[54] SENSITIZERS AND PROCESS FOR ELECTROLESS METAL DEPOSITION

[75] Inventors: Richard K. Kremer, Glen Oaks; Rudolph J. Zeblisky, Hauppauge, both of N.Y.

[73] Assignee: Photocircuits Division of Kollmorgen Corporation, Glen Cove, N.Y.

[22] Filed: July 11, 1974

[21] Appl. No.: 487,738

Related U.S. Application Data

[63] Continuation-in-part of Ser. No. 384,691, Aug. 1, 1973, abandoned.

[52] U.S. Cl. ..... 427/304; 106/1; 427/328

[51] Int. Cl.[2] ..... C23C 3/02

[58] Field of Search ..... 117/130 E, 47 A; 106/1; 427/304, 305, 306, 328

[56] References Cited

UNITED STATES PATENTS

| | | | |
|---|---|---|---|
| 3,403,035 | 9/1968 | Schneble et al. | 117/130 E |
| 3,627,558 | 12/1971 | Roger et al. | 117/47 A X |
| 3,672,923 | 6/1972 | Zeblisky | 117/47 A X |
| 3,672,938 | 6/1972 | Zeblisky | 117/47 A |
| 3,682,671 | 8/1972 | Zeblisky | 117/47 A X |

*Primary Examiner*—Ralph S. Kendall
*Assistant Examiner*—John D. Smith
*Attorney, Agent, or Firm*—Morgan, Finnegan, Pine, Foley & Lee

[57] ABSTRACT

There are provided stable, non-colloidal solutions for sensitizing a surface to the deposition of adherent electroless metal, the solutions comprising a liquid medium and dissolved therein an effective, sensitizing amount of a reaction product of the general formula:

A · D · E · G wherein A is an ion of a precious metal selected from those of the fifth and sixth periods of Groups VIII and IB of the Periodic Table of elements; D is a group IV metal of the Periodic Table of Elements which is capable of two valence states; E is an anion capable of forming a stable complex with components A and D; and G is a hydroxyl group-containing aromatic organic compound capable of forming a stable complex with component A, or component D.

24 Claims, No Drawings

SENSITIZERS AND PROCESS FOR ELECTROLESS METAL DEPOSITION

CROSS-REFERENCE TO RELATED APPLICATION

This application is a continuation-in-part of our copending application, Ser. No. 384,691 filed on Aug. 1, 1973, now abandoned.

BACKGROUND OF THE INVENTION

1. Field of the Invention

This invention relates to stabilized precious metal sensitizing solutions. The stabilized solutions are used to render surfaces of a substrate catalytic to the reception of an electroless metal.

2. Prior Art

The electroless deposition of a metal on either a metallic or non-metallic substrate usually requires pretreatment or sensitization of the substrate to render it catalytic to the reception of such deposit. Various methods have evolved over the years employing sensitizing compositions.

One of the earliest innovations employed a plurality of baths in which the substrate was subjected to a two-step process entailing immersion first in a stannous chloride solution, followed by a second immersion in an acidic palladium chloride solution. More recently, there has been proposed a unitary treating process which employs a colloidal dispersion — as contrasted to a clear solution — of precious metal, e.g., palladium and a Group IV polyvalent metal, e.g., tin; see Shipley, U.S. Pat. No. 3,001,920. A substantial improvement was provided with the development of optically clear, true solutions of complexes of precious metal and Group IV metals. See, for example, the $PdCl_2.SnCl_2$ reaction products and related sensitizers described in Zeblisky, U.S. Pat. No. 3,672,938. These latter are provided both in concentrated form (Zeblisky, U.S. Pat. No. 3,682,671) and in a dilutable dry powder form (Zeblisky, U.S. Pat. No. 3,672,923). All of these patents are incorporated herein by reference to save unnecessarily detailed description of components, ratios, methods of using the same, and the like.

The old plural bath process, while readily effecting sensitization, deposits a flash coating of the precious metal onto metallic substrates. The precious metal so flash coated from the sensitizing bath disrupts the balance of the bath, causing a loss in stability and a change in concentration. To maintain catalytic activity, the frequent addition of the precious metal bearing solution to such baths is required. It is obvious that this increases the cost of the plural bath process. Furthermore, any flash coating of precious metal normally leads to a low grade of adhesion, thereby materially affecting the bond and peel strength of any subsequent electroless metal deposit.

The colloidal unitary bath process of the Shipley patent, on the other hand, while frequently overcoming the problem of flash coating, has a diminished reactivity in the sense that higher concentrations of precious metal are needed and the bath requires longer periods of time for sensitization. In addition, double metal colloids are needed to improve stability. Moreover, because the precious metal is present in colloidal form, dilutable concentrates of such baths cannot be prepared and shipped and stored because of destruction of the colloidal dispersion by flocculation. As is explained in the above-mentioned '671 and '923 patents, concentrated or dry forms of the unitary bath sensitizers are uniquely useful because shipping and storage costs are minimized; and the process solutions are more simply put together (by dilution, for example). A major disadvantage of such solutions is that they tend to be unstable, especially on esposure to air. After a few weeks, under such conditions, precious metal tends to separate from the solution as a metallic film on the surface of the solution and sometimes as a granular precipitate. If the solution in this state is used to sensitize surfaces for subsequent electroless plating by immersing the surfaces in the solution, upon removal, the surface is coated with a layer of the precious metal which cannot easily be removed by rinsing. If electroless is effected without removing the precious metal coating, the plated metal has poor adhesion to the underlying surface.

In U.K. Pat. No. 1,174,851, sensitizing solutions of the unitary type having improved stability are provided by merely adding a water-soluble, hydroxyl group-containing organic compound, as a stabilizer, e.g., an alcohol, glycerine, a sugar, and the like. According to the U.K. patent, the best stabilizers comprise hydroxyl group-containing aromatic compounds, such as resorcinol, catechol, quinol, and the like, because they can be used in somewhat lower concentrations than alcohols, sugars, etc. These water-soluble hydroxy-aromatic compounds, like the others, are merely to be added to the sensitizing solution, after it is prepared, and the sensitizing solution is said to be rendered stable for at least five months. There is no suggestion in the U.K. patent of any need to put the ingredients together in any specific way, and the patent is silent regarding the appearance, and especially the color of the stabilized sensitizing solutions.

Even though the U.K. patent provides a stable, active sensitizing solution, if the hydroxyl group-containing compound is merely added to the sensitizer solution in the concentrations specified, the solutions are rather slow in their sensitizing activity, immersion times of 15 to 20 minutes being usually required. Moreover, after prolonged storage, there is still some tendency for precious metal to precipitate from the solution and to cause the disadvantages enumerated above.

It has now been discovered that if a hydroxyl group-containing aromatic compound of the type described in the U.K. patent is added in a novel way and at the proper time while preparing a soluble complex metal sensitizer of the type disclosed and claimed in the aforesaid Zeblisky patents, there is produced a reaction product which apparently includes the hydroxyl group-containing aromatic compound. Such solutions unexpectedly provide a substantial increase in the speed of sensitization, acting, in some cases, twice as fast as the best of those described in the prior art. Moreover, and particularly with respect to the stabilized sensitizer of U.K. Pat. No. 1,174,851, there is a substantial improvement in stability and a superior product is formed. A different product is formed herein because of color differences as will be described hereinafter, and these are presumably due to the presence of a complex involving the precious metal and the hydroxy aromatic compound. In the case of palladium and resorcinol, for example, a red complex can be formed, and this color has not before been observed with these components.

It is surprising the view of the U.K. patent that all hydroxyl containing compounds are not suitable. For example, the isopropanol specified as a preferred stabilizer therein will not produce the novel reaction product discovered by applicants herein.

Accordingly, it is a primary object of the present invention to provide a new sensitizer composition which is highly active and stable, as well as processes using such a composition to effect the sensitization of a substrate to render it catalytic to the reception of an electroless metal deposit. It is contemplated also to provide such sensitizers in the form of concentrates and dry, dilutable solids, as generally dscribed in the relevant aforementioned Zeblisky patents.

Another object of the present invention is to provide new and useful stabilized compositions which have greater activity as sensitizers and which are very resistant to the effects of contamination. Such compositions provide more stable sensitizers with greater economy in the use of meterials.

SUMMARY OF THE INVENTION

According to the present invention, there are provided sensitizer solutions for sensitizing a surface to the deposition of adherent electroless metal, the solutions comprising a liquid medium, and dissolved therein an effective, catalytic amount of a reaction product of the general formula:

A · D · E · G wherein A is an ion of a precious metal selected from those of the fifth and sixth periods of Groups VIII and IB of the Periodic Table of Elements; D is an ion of a Group IV metal of the Periodic Table of Elements which is capable of two valence states; E is an anion capable of forming a stable complex with components A and D; and G is a hydroxyl group-containing aromatic organic compound capable of forming a stable, soluble complex with the precious metal ion A, or Group IV metal ion D. This invention also includes processes for preparing these sensitizing solutions.

A special feature of this invention is a process for sensitizing a substrate to be plated with an adherent electroless metal, said process comprising contacting the substrate with a sensitizer solution as above defined.

DESCRIPTION OF THE SPECIFIC EMBODIMENTS.

The sensitizer solution comprises a liquid medium containing the reaction product in dissolved form. The liquid medium can vary broadly, but it should not be reactive with the other ingredients. Preferably, it may be water or an oxygen-containing organic liquid. Illustrative of the latter are alcohols, e.g., methanol, ketones, e.g., cyclohexanone, ethers, e.g., dibutyl ether, and the like. Preferably, for economy, water is used as the liquid medium.

Among the ions of precious metals which can be used as component A are those of Periods 5 and 6 of Groups IB and VII of the Periodic Table of Elements. Special mention is made of palladium, platinum, gold, rhodium, osmium and iridium. The preferred ions of precious metals are palladium and platinum.

The preferred Group IV metal ion is tin, especially stannous tin.

If water is the liquid medium, it is preferred that the pH of the solution be maintained below about 1.0. If nonaqueous media are used, wherein pH measurements are not reliable, then strongly acidic conditions are preferred in any event.

In preferred embodiments, the precious metal ions will be present in the form of a reaction product with components D and E and there will be a stoichiometric excess of components D and E with respect to component A. In its broadest aspects, the preferred compositions of this invention contain a soluble reaction product of precious metal ion and the hydroxyl group-containing aromatic organic compound, and the solution will contain, in addition, an excess of a stoichiometric amount for complexing of unreacted stannous tin ion, and a hydrohalic acid, e.g., HCl or HBr, in an amount sufficient to provide an excess of a stoichiometric amount for complexing of its anion.

It is to be understood that both the foregoing general description and the following detailed description are exemplary and explanatory and are not restrictive of the invention. For example, while copper desposition is more fully described, the teachings are applicable to nickel, palladium, cobalt, silver and gold deposition as well.

The stabilized compositions of this invention will cause conductive and nonconductive materials to be so sensitized simultaneously that efficient and uniform deposition of an adhereing electroless metal thereon may be readily effected. This permits, by way of illustration, copper plating of nonmetallic surfaces of side walls in apertures in a plastic base material, as well as the concomitant adherent electroless deposition of copper on preformed copper surfaces on the base. Illustrative of the conductive and nonconductive, metallic and nonmetallic surfaces which can be plated uniformly with adherent electroless metal by use of the sensitizing solutions and techniques of the present invention are plastic surfaces and surfaces of metallic copper, iron-nickel, cobalt, silver, gold and alloys thereof, such as stainless steel, brass, sterling silver, and the like.

The sensitizing solutions will comprise a solution in a liquid medium of a reaction product of a precious metal, a Group IV metal, an anion and the hydroxyl group-containing aromatic organic compound. They will be optically clear, i.e., noncolloidal. As mentioned above, the precious metals will include palladium, platinum, gold, rhodium, osmium, iridium and mixtures of these metals. The inorganic and organic acid salts of these metals and of the Group IV metals, such as the chlorides, bromides, fluorides, fluoborates, iodides, nitrates, sulfates and acetates of stannous tin, titanium and germanium among others may be used to form components A, D and E. Other salts and compounds of the precious metals and Group IV metals will readily suggest themselves to those skilled in the art. For convenience, the salts and compounds are preferably soluble in water, or in organic or inorganic acid aqueous solutions. For providing the anion E, the chloride is preferred, both for the precious metal and the Group IV metal compound. The preferred precious metals are palladium or platinum, particularly palladium, and preferred Group IV metal is stannous tin.

In the sensitizing solution bath the precious metal ion concentration should be from at least about 0.0003 to about 10 grams per liter, preferably from 0.01 to 5.0 grams per liter of solution. While concentrations in the higher end of this range cause sensitization to be completed in very abbreviated periods of time, e.g., 10 seconds, a quantity in the lower end of this range is normally more economic. The bath can be prepared directly or by diluting a concentrate, e.g., one in which the concentration of precious metal ion ranges from 4 to 8 g./l. or higher. Obviously, dry concentrates can also be diluted to concentrations normally used.

In one manner of proceeding, the concentrates or the dry solids are diluted with water, an appropriate liquid, e.g., methanol or cyclohexanone, or an aqueous solution of suitable acid. The compositions are prepared by reacting the precious metals and a Group IV metal, in the form of salts in a liquid medium, e.g., an aqueous solution of suitable acid as will be described hereinafter. Among the acids that can be used are hydrochloric acid, hydrofluoric acid, fluoboric acid, hydroiodic acid, sulfuric acid and acetic acid. Preferably, the anion of the inorganic acid corresponds to the anion of the salt of the precious metals, or to the anion of the Group IV metal salt. Where the anions of the precious metal salt and the Group IV metal salt are the same, the anion of any acid used in the sensitizing solution should preferably correspond to the common anion of the salts. However, where the anion of the precious metal differs from that of the Group IV metal salt, the anion of any acid used will preferably correspond to that of the precious metal salt. It is to be understood that acids having anions which differ from the anions of the precious metal salts or of the Group IV metal salts may also be used. In any event, the preferred anions are $Cl^-$, $SnCl_3^-$ are mixtures thereof.

In those embodiments which are acidic, the concentration of the acid in the sensitizing solutions and in the concentrates depends upon the strength of the acid employed. For best results, the concentration of any acid in the final solution should be at least 0.001 Normal. At the upper end, and especially in a concentrate, the concentration of acid may be as high as 15 Normal, or even higher. When strong acids are used, the concentration of the acid in the sensitizing solution approaches the upper limit given hereinabove. The concentration of acid in the sensitizing solution should, of course, be high enough to solubilize the salts of the precious metals and the Group IV metal and also high enough to render the solution suitable for use as a sensitizer for the material being treated. Care should be used in selecting the acid concentration to insure that the specimen being treated is not adversely attacked or corroded by the treating solution.

The group IV metal ion concentration may vary widely but must be maintained in excess of a stoichiometric amount based on the amount of precious metal ions present in the sensitizing solution. Although, normally a large excess of, for example, stannous chloride, is maintained to allow for air oxidation of the stannous ion, when the precious metal is complexed with the hydroxyl group-containing aromatic organic compound, such large excesses are not needed. Illustratively, concentrations of as high as 60 grams per liter, or more, of Group IV metal ion are not detrimental to the effectiveness of the sensitizing activity of the diluted solutions.

The use of hydroxyl group-containing aromatic organic compounds as components in the sensitizing solutions of this invention is responsible for the remarkable stability of the solutions, for their rapid sensitization ability and for avoiding formation of precious metal residues on surfaces, e.g., metal surfaces, exposed to such solutions. The chemical nature of the hydroxyl group-containing aromatic compound is not particularly critical. It can be simple or complex, but at least one of the hydroxyl groups must be bound to the aromatic ring. Other groups, e.g., sulfonate, nitrate, alkyl, halide, and the like, can also be present. Evidence of effective stabilization is easily observed in comparison with control baths, i.e., those without a hydroxyl group-containing aromatic component. These latter baths over a period of one week or so will be seen to deposit a metallic film of precious metal or to deposit a precipitate of precious metal. On the other hand, baths which contain the A · D · E · G complex described herein will remain clear and be stable and storable for periods of at least two weeks and even longer.

Component G will preferably be a benzene or naphthalene derivative containing one or more nuclear substituted hydroxyl groups. Suitable such compounds are resorcinol, catechol, hydroquinine, phloroglucinol, phenol, pyrogallol, anthraquinone, sulfonated phenols, and the like. Preferably, resorcinol will be used.

It is important when preparing the sensitizing solutions according to the instant invention, to add the components to each other and react them in a suitable order so that the components of the solutions do not react to form a colloidal dispersion, colloidal agglomerates, or mixed complexes instead of the four component reaction product.

In general, the compositions of this invention are prepared by mixing a solution of the precious metal salt with the hydroxyl group-containing organic compound to form what is believed to be a soluble reaction product or complex. See, for example, the chemistry described in Chemical and Engineering News, Apr. 21, 1969, pgs. 48–52. This solution is then mixed with a solution of the Group IV metal cation. One or, preferably, both solutions will contain the required anion E. In general, a solution of components A, E and G will be mixed with a solution of components D and E and reacted to form the complex A · D · E · G. It is important, for best results, to accelerate the formation of the A · D · E · G complex by heating, and the progress of the reaction can be followed, e.g., by monitoring the color changes which occur. These will be described hereinafter. Heating at a temperature of between about 65°C., preferably about 85°C., and the boiling point of the solution has been found to provide the complex at a convenient rate. Usually, from about 20 minutes to about 6 hours of heating is employed. Typically, about 2 to 3 hours of heating at the boiling point is more than adequate.

A solution suitable for use directly and economically will contain the following components (on an unreacted basis): A, from 0.001 to 5 and preferably, from 0.2 to 2 g./l.; D, from 15 to 60 g./l.; E, from 5 to 20 g./l. and G, from 1 to 25 g./l. On the other hand, a convenient dilutable concentrate will contain, on the same basis A, e.g., palladium or platinum ion, from 4 to 10 g./l.; D, e.g., stannous ion, from 400 to 600 g./l.; E, e.g., chloride ion, from 150 to 400 g./l.; G, e.g., resorcinol, catechol, hydroquinone, anthraquinone, phenol, phloroglucinol, etc., from 25 g./l. to saturation. Typical upper limits for component G will be, e.g., 200 g./l., 175 g./l. or 75 g./l., and the like, in water, methanol, cyclohexanone, and the like. The concentrates can be evaporated to dryness in a vacuum to produce a friable, dry solid as is described in U.S. Pat. No. 3,672,923. Both the concentrate and the dry solid can be diluted just prior to use with water, aqueous acid or a nonaqueous medium, as is described in the above-identified patents.

Because the cleaning of substrates and the deposition of electroless metal thereon are well known to those skilled in the art, reference is made to one or more of the above-mentioned patents. The step of sensitizing a clean substrate will be described in detail hereinafter.

In a preferred embodiment, and according to conventional practice, a wetting agent will be included in the sensitizer composition. Preferred for this purpose are fluorinated surfactants, such as perfluorodecanoic acid, and commercial formulations such as the product designated FC-95 by its supplier, The 3M Company. Small, effective amounts, of the order of 0.25 to 2.5 g./l. will be used.

The following non-limitative examples illustrate the composition and process of this invention.

EXAMPLE 1

A first solution is prepared by dissolving 160 g. of resorcinol in 170 ml. of distilled water. This solution is pale yellow. Moderate heating will aid the dissolution of resorcinol, since the reaction is endothermic.

A second solution is prepared by dissolving 8.0 g. of $PdCl_2$ in 80 ml. of 37% hydrochloric acid (providing sufficient time for all the $PdCl_2$ to dissolve). This solution is brown.

The first solution is then added to the second solution and the mixture is allowed to stand for one-half to one hour. This solution is dark brown in color.

A third solution is prepared by mixing 65 ml. of deionized water with 441 ml. of 37% hydrochloric acid and dissolving therein 560 g. of anhydrous stannous chloride; and a small amount of precipitated solids and residues is removed by filtration.

To 720 ml. of the third solution is slowly added 360 mls. of the premixed first and second solutions. The mixture is first, transitorily dark bluish in color, changing to a blue green and finally to green. At this point, the mixture is heated to about 100°C., then held for a total elapsed time of 2 to 3 hours, maintaining a temperature between 100° and 110°C. The concentrated reaction product is allowed to cool to room temperature at which time it has a purplish-brown color and is analyzed for palladium and stannous ions. Dilution with 4N hydrochloric acid provides a red-brown color. Adjustments in the excess ions will be made by adding hydrochloric acid, water and stannous chloride. Optionally, 0.8 g. of fluorinated hydrocarbon wetting agent, FC-95, may also be added.

The procedure provides a composition with a concentrated reaction product of 8 g./l. of $PdCl_2$, 500–560 g./l. of $SnCl_2$, 540–580 mls./l. of Hcl and 45–50 g./l. of resorcinol.

It is stable for months and, when diluted to operating concentrations, sensitizes all conventional substrates very rapidly and effectively.

EXAMPLE 2

This is a modification of Example 1 wherein part of the hydroxyl group-containing organic compound is complexed with palladium first and the remainder is added with the stannous ion. The temperatures and times are generally the same.

A first solution is prepared by dissolving 160 g. of resorcinol in 140 ml. of water.

A second solution is prepared by dissolving 8 g. of $PdCl_2$ in 80 ml. of 37% hydrochloric acid.

Part of the first solution, 150 ml., is diluted with 26 ml. of water and this is added to the second solution.

A third solution is prepared by dissolving 560 g. of $SnCl_2$ in 475 ml. of water.

The remainder of the first solution, 130 ml., is then added to the third solution, and this results in a light yellow colored solution.

Finally, the mixture of the diluted portion of the first solution and the second solution is then slowly added to the mixture of the third solution and the undiluted portion of the first solution and reacted as in Example 1. The color changes are substantially the same and a stable, highly effective sensitizing solution concentrate is obtained.

EXAMPLE 3

This is a modification of Examples 1 and 2 wherein all of the hydroxyl group-containing aromatic compound is reacted with the stannous ion and then mixed with the palladium ion.

A first solution is prepared by dissolving 160 g. of resorcinol in 140 ml. of water.

A second solution is prepared by dissolving 8 g. of $PdCl_2$ in a mixture of 80 ml. of 37% hydrochloric acid and 70 ml. of water.

A third solution is prepared by dissolving 560 g. of $SnCl_2$ in 475 ml. of 37% hydrochloric acid and 26 ml. of water.

Two hundred and eighty milliliters of the first solution is added to the third solution with thorough mixing; then the second solution is added to this mixture and reacted as in Example 1. A stable, active concentrate is produced, but it is not quite as stable as those produced in Examples 1 and 2.

EXAMPLE 4

The concentrate of Example 1 in the amount of 63 ml. is diluted with a mixture of 620 ml. of water and 320 ml. of reagent grade hydrochloric acid (37%) to a content of palladium chloride concentration corresponding to 0.5 g./l. A clean panel is immersed in the sensitizing bath for a suitable period of time, e.g., from 3 to 15 minutes. The panel surfaces including any side walls of the apertures defined therein are thereafter thoroughly rinsed with water to entirely remove the sensitizing solution therefrom. The panel is then passed into a bath of diluted fluoboric acid, e.g., about 10% in water, the immersion requiring about 30 to 10 seconds, and then the panel is again rinsed with water.

The sensitized panel can then be immersed in a conventional electroless metal bath comprising an aqueous solution of a water-soluble salt of the metal to be plated, a water-soluble reducing agent for the salt, and various water-soluble additives for improving the stability of the solutions. See, e.g., the above-mentioned Zeblisky patents.

Electroless metal deposition may be followed by electroplating with copper or other metals to build up metal thicknesses of 0.01 to 0.002 inch or greater.

EXAMPLE 5

The procedure of Example 1 is repeated, substituting 4.35 g. of $PtCl_2$ for $PdCl_2$. A stabilized platinum ion containing sensitizing solution according to this invention is obtained.

EXAMPLE 6

The procedure of Example 1 is repeated, substituting 8 grams of osmium chloride for the 8 grams of palladium chloride. A stabilized osmium ion containing sensitizing solution according to this invention is obtained.

EXAMPLE 7

A first solution is prepared by dissolving 64 g. of catechol in 200 ml. of water.

A second solution is prepared by dissolving 8.0 g. of $PdCl_2$ in 80 ml. of 37% hydrochloric acid (providing sufficient time and moderate heating to dissolve all the $PdCl_2$).

The first solution is then added to the second solution and the mixture is maintained for one-half to 1 hour.

A third solution is prepared by mixing 65 ml. of deionized water with 441 ml. of 37% hydrochloric acid and dissolving therein 560 g. of anhydrous stannous chloride, and a small amount of precipitated solids and residues is removed by filtration.

To 720 ml. of the third solution is slowly added 360 mls. of the premixed first and second solutions. The mixture is then heated to about 100°C., then held for a total elapsed time of 2 to 3 hours, maintaining a temperature of between 100 and 110°C. The concentrated reaction product is then allowed to cool to room temperature and adjusted to any desired concentration with 4N hydrochloric acid. A stable, active sensitizing solution is obtained.

EXAMPLE 8

The procedure of Example 7 is repeated, substituting for the first solution, a solution of 69 g. of pyrogallol in 200 ml. of water. A stable, active sensitizing solution is obtained.

EXAMPLE 9

The procedure of Example 1 is repeated, substituting for the first solution, a solution of 24 g. of hydroquinone in 200 ml. of water. A stable, active sensitizing solution is obtained.

Although the invention has been described and illustrated by reference to particular embodiments thereof, it will be understood that in its broadest aspects the invention is not limited to such embodiments and that variations and substitution of such equivalents may be restored to within the scope of the appended claims.

We claim:

1. A clear solution for sensitizing a surface to the deposition of adherent electroless metal, said solution consisting essentially of a liquid medium and the reaction product of admixing and heating A, D, E and G, wherein:

A is an ion of a precious metal selected from those of the fifth and sixth periods of Groups VIII and IB of the Periodic Table of Elements:

D is an ion of a Group IV metal of the Periodic Table of Elements which is capable of two valence states;

E is an anion capable of forming a stable complex with components A and D; and

G is a hydroxyl group-containing aromatic organic compound capable of forming a stable, soluble complex with the precious metal ion A or the Group IV metal ion D;

said admixing comprising the steps:

1. forming a first solution comprising A and E and a second solution comprising D and E, with at least one of said solutions also comprising G; and
2. adding said first solution to said second solution.

2. A sensitizer solution as defined in claim 1, wherein the concentration of component A is from 0.001 to 5 g./l. and the solution contains a sufficient excess of unreacted components D and E to provide a stable solution.

3. A sensitizer solution as defined in claim 2, wherein there is an excess of unreacted component G.

4. A sensitizer solution as defined in claim 1 wherein the concentration of component A is from 0.2 to 2 g./l., component D is from 15 to 60 g./l., component E is from 5 to 20 g./l. and component G is from 1.0 to 25 g./l.

5. A sensitizer solution as defined in claim 1 wherein component A is palladium ion.

6. A sensitizer solution as defined in claim 1 wherein component A is platinum ion.

7. A sensitizer solution as defined in claim 1 wherein component D is stannous ion.

8. A sensitizer solution as defined in claim 1 wherein component E is an anion of the group consisting of $Cl^-$, $SnCl_3^-$, and mixtures thereof.

9. A sensitizer solution as defined in claim 1 wherein component G is a compound of the group consisting of resorcinol, catechol, hydroquinone, anthraquinone phenol, phloroglucinol and mixtures thereof.

10. A sensitizer solution as defined in claim 9 wherein component G is resorcinol.

11. A sensitizer solution as defined in claim 1 wherein said liquid medium is of the group consisting of water, an oxygen-containing organic compound and mmixtures thereof.

12. A sensitizer solution as defined in claim 11 wherein said liquid medium is of the group consisting of water, methanol and cyclohexanone.

13. A sensitizer solution as defined in claim 1 in which component A is palladium ion, component D is stannous ion, component E is an anion of the group consisting of $Cl^-$, $SnCl_3^-$ and mixtures thereof, and component G is resorcinol.

14. A dilutable concentrate for a sensitizer solution as defined in claim 1 which contains a soluble complex, the components of which are at a concentration of 4 to 10 g./l. of palladium ion, from 400 to 600 g./l. of stannous tin ion, from 150 to 400 g./l. of chloride ion and from 25 g./l. to the saturation concentration of a hydroxyl group-containing aromatic compound of the group consisting of resorcinol, catechol, hydroquinone, anthraquinone, phenol, phloroglucinol and mixture thereof.

15. A dilutable concentrate for a sensitizer solution according to claim 14 wherein said hydroxyl group-containing aromatic organic compound is resorcinol.

16. A sensitizer solution as defined in claim 1 which also includes a small effective amount of a fluorinated hydrocarbon wetting agent.

17. A process for preparing a sensitizer solution as defined in claim 1 wherein a solution of the components A, E and G is mixed with a solution of the components D and E and the resulting mixture is heated.

18. A process for preparing a sensitizer solution as defined in claim 1 wherein a solution of the components A, E and G is mixed with a solution of the components, D, E and G and the resulting mixture is heated.

19. A process for preparing a sensitizer solution as defined in claim 25 wherein a solution of the components A and E is mixed with a solution of the components D, E and G and the resulting mixture is heated.

20. A process as defined claim 17 wherein the reactants are heated at a temperature of from about 65°C. to about the boiling point of said mixture.

21. A process as defined in claim 18 wherein the reactants are heated at a temperature of from about 65°C. to about the boiling point of said mixture.

22. A process as defined in claim 19 wherein the reactants are heated at a temperature of from about 65°C. to about the boiling point of said mixture.

23. A process for sensitizing a substrate to be plated with an adherent electroless metal which comprises contacting the substrate with a sensitizing solution as defined in claim 1.

24. A clear solution for sensitizing a surface to the deposition of adherent electroless metal, said solution consisting essentially of water and the reaction product of admixing and heating palladium ions, stannous ions, chloride ions and resorcinol, wherein said admixing comprises the steps:

1. forming a first solution comprises palladium ions and chloride ions and a second solution comprising stannous ions and chloride ions, with at least one of said solutions also comprising resorcinol; and
2. adding said first solution to said second solution.

* * * * *

UNITED STATES PATENT AND TRADEMARK OFFICE

CERTIFICATE OF CORRECTION

PATENT NO. : 3,961,109

DATED : June 1, 1976

INVENTOR(S) : Richard L. Kremer and Rudolph J. Zeblisky

It is certified that error appears in the above-identified patent and that said Letters Patent are hereby corrected as shown below:

On the Title page, item 75, "Richard K. Kremer" should read -- Richard L. Kremer --.

In Column 10, line 29, "mmixtures" should read -- mixtures --;

In Column 10, line 63, "25" should read -- 1 --; and

In Column 12, line 7, "comprises" should read -- comprising --.

Signed and Sealed this

Twenty-eighth Day of September 1976

[SEAL]

*Attest:*

RUTH C. MASON
*Attesting Officer*

C. MARSHALL DANN
*Commissioner of Patents and Trademarks*